US011139621B2

(12) United States Patent
Cyzen

(10) Patent No.: US 11,139,621 B2
(45) Date of Patent: Oct. 5, 2021

(54) PLUG RETENTION SYSTEM

(71) Applicant: Keith Cyzen, Glen Ellyn, IL (US)

(72) Inventor: Keith Cyzen, Glen Ellyn, IL (US)

( * ) Notice: Subject to any disclaimer, the term of this patent is extended or adjusted under 35 U.S.C. 154(b) by 0 days.

(21) Appl. No.: 16/752,178

(22) Filed: Jan. 24, 2020

(65) Prior Publication Data

US 2020/0244019 A1 Jul. 30, 2020

Related U.S. Application Data

(60) Provisional application No. 62/796,936, filed on Jan. 25, 2019.

(51) Int. Cl.

| | |
|---|---|
| ***H01R 24/76*** | (2011.01) |
| ***H01R 13/426*** | (2006.01) |
| ***H01R 13/639*** | (2006.01) |
| ***H01R 13/58*** | (2006.01) |

(52) U.S. Cl.

CPC ..... *H01R 24/76* (2013.01); *H01R 13/426* (2013.01); *H01R 13/58* (2013.01); *H01R 13/6395* (2013.01); *H01R 2201/26* (2013.01)

(58) Field of Classification Search

CPC ..... H01R 24/76; H01R 13/426; H01R 13/58; H01R 13/5804; H01R 13/6395; H01R 2201/26

USPC ..... 439/34

See application file for complete search history.

(56) References Cited

U.S. PATENT DOCUMENTS

| | | | |
|---|---|---|---|
| 5,736,830 | A | 4/1998 | Weng |
| 6,211,464 | B1 | 4/2001 | Mochizuki et al. |
| 6,257,923 | B1 | 7/2001 | Stone et al. |
| 6,612,875 | B1 | 9/2003 | Liao |
| 6,923,686 | B1 | 8/2005 | Cheng |
| 7,094,099 | B2 | 8/2006 | Daggett et al. |

(Continued)

FOREIGN PATENT DOCUMENTS

| | | | |
|---|---|---|---|
| GB | 2411777 | A | 9/2005 |
| KR | 20090004005 | U | 4/2009 |

(Continued)

OTHER PUBLICATIONS

International Application No. PCT/US2020/015024, International Search Report and Written Opinion, dated May 19, 2020.

*Primary Examiner* — Oscar C Jimenez

(74) *Attorney, Agent, or Firm* — Marshall, Gerstein & Borun LLP

(57) ABSTRACT

A retention assembly is provided that is configured to retain a plug end of an electrical cord in electrical engagement with an accessory outlet. The retention assembly includes a housing have an interior sized to receive the plug end and, optionally, an adapter therein. In one version, the housing can include a front opening with an assembly portion and a retention portion where the retention portion has at least one dimension that is smaller than the corresponding dimension of the plug end so that the plug end cannot pass therethrough. In another version, the retention assembly includes an insert having a slot opening to receive the wire portion of the electrical cord therethrough. The insert can then be disposed within the housing such that a sidewall of the insert extends between a front wall of the housing and the adapter to restrict movement of the first end and the adapter.

26 Claims, 7 Drawing Sheets

(56) References Cited

U.S. PATENT DOCUMENTS

| | | | | |
|---|---|---|---|---|
| 7,384,304 | B1 * | 6/2008 | Fawcett | H01R 13/6395 439/567 |
| 7,654,855 | B2 | 2/2010 | Liao | |
| 7,699,633 | B2 | 4/2010 | Cheng | |
| 8,137,129 | B2 | 3/2012 | Woods | |
| 9,071,009 | B2 | 6/2015 | Ardisana et al. | |
| 9,472,913 | B1 | 10/2016 | Mizrahi | |
| 10,439,327 | B1 * | 10/2019 | Cyzen | H01R 25/006 |
| 2005/0189911 | A1 | 9/2005 | Cheng | |
| 2013/0244475 | A1 | 9/2013 | Sayadi et al. | |
| 2018/0323537 | A1 | 11/2018 | Ma et al. | |
| 2020/0295801 | A1 * | 9/2020 | Cyzen | H04B 3/542 |

FOREIGN PATENT DOCUMENTS

| | | | |
|---|---|---|---|
| WO | WO-2014/164169 | A1 | 10/2014 |
| WO | WO-2018/068109 | A1 | 4/2018 |

* cited by examiner

PLUG RETENTION SYSTEM

CROSS-REFERENCE TO RELATED APPLICATION

Priority is claimed to U.S. Provisional Patent Application No. 62/796,938, filed Jan. 25, 2019, the entire contents of which are hereby incorporated herein by reference.

FIELD OF THE DISCLOSURE

The present disclosure generally relates to plugs for electronic devices and, more particularly, to retention components for electrical outlets.

BACKGROUND

Cords to recharge and connect mobile devices have taken on many forms with advances in technology. In one current form, a cord includes a connector at a first end thereof that is configured to connect to the mobile device and another connector at a second end to connect to a power source or second electronic device. One common connector for the second end is a Universal Serial Bus (USB) connector that allows the mobile device to be connected to a computing device or power source having a corresponding port. The USB connector can also be utilized in conjunction with an adapter to plug the mobile device into a wall outlet or a vehicle's 12V auxiliary power outlet (i.e., cigarette lighter outlet) to recharge the mobile device. Unfortunately, with the increase in connections, the chance that one of the connections is inadvertently separated increases. For example, ride-sharing has become an increasing popular form of public transportation. While it may be courteous to provide riders access to a cord for charging their electronic devices during rides, the cord may become inadvertently or intentionally disconnected from the car and taken from the vehicle.

SUMMARY

In accordance with a first aspect, a retention assembly for securing a first end of an electrical cord to a power outlet of a vehicle is described herein that includes a housing having an interior sized to receive a first end of an electrical cord therein with a plug portion of the first end received within a port electrically coupled to a power outlet of a vehicle. The housing includes a front wall, a generally cylindrical sidewall extending rearwardly from a first end at the front wall to a second end and defining a rear opening sized to extend around the power outlet of the vehicle, and a flange extending outwardly from the second end of the sidewall. The front wall of the housing includes a front opening extending therethrough with an assembly portion sized to receive the first end or a second end of the electrical cord therethrough and a smaller, lateral retention portion sized to receive a wire portion of the electrical cord therein, where the retention portion is configured to align along an axis of the port.

According to some forms, the assembly can include one or more of the following aspects: the flange can include one or more openings extending therethrough to receive a fastener to secure the housing to a structure of the vehicle; the power outlet can be an accessory outlet, the ports can be USB ports provided by an adapter configured to be inserted into the accessory outlet; and the housing can be sized to receive portions of the adapter therein with the housing secured to a structure of the vehicle; the front wall can include an outwardly projecting front flange to retain a wire portion of the electrical cord wrapped around the housing and, in further forms, the front flange can include one or more slot openings extending therethrough sized to retain the wire portion of the electrical cord inserted therein; the assembly can include a spacer configured to engage a wire portion of the electrical cord and be sized to span a majority of a gap between the first end of the electrical cord and the front wall, where, in some versions, the spacer has annular body with a longitudinal slit extending therethrough to be coupled around the wire portion of the electrical cord; the sidewall can be a generally half-barrel shaped sidewall; or the interior of the housing can be sized to receive first ends of two electrical cords therein in a side-by-side relation with plug portions of the first ends received within ports electrically coupled to the power outlet of the vehicle and the front opening can include two smaller, lateral retention portions each sized to receive wire portions of one of the electrical cords therein, where the retention portions are configured to align along respective axes of the ports.

According to some forms, the assembly can include a mounting base having one or more bores configured to align with the openings of the flange and receive a fastener therein to secure the housing to the mounting base. In further forms, the housing can include a skirt that extends rearwardly from an outer edge of the flange and the mounting base can have a tubular configuration sized to be received within a volume defined partially by the flange and skirt of the housing.

According to some forms, the housing can include a divider wall extending across the interior that, in combination with the sidewall, defines compartments for the first ends adjacent to the front wall. In further forms, the divider wall can define a window adjacent to the front wall that has edges extending to edges of the front opening allowing a user to maneuver the first ends into the housing.

In accordance with a second aspect, a retention assembly for securing a first end of an electrical cord to a power outlet of a vehicle is described herein. The retention assembly includes an adapter having a port on a proximal end configured to receive a plug portion of a first end of an electrical cord therein and a plug on a distal end configured to electrically couple with a power outlet. The retention assembly further includes a housing having an interior sized to receive the first end of the electrical cord and portions of the adapter therein with the plug portion inserted into the port and the adapter inserted into the power outlet. The housing includes a front wall, a generally cylindrical sidewall extending rearwardly from a first end at the front wall to a second end defining a rear opening sized to extend around the power outlet of the vehicle, and a flange extending outwardly from the second end of the sidewall. The front wall includes a front opening extending therethrough and the front opening includes an assembly portion sized to receive the first end or a second end of the electrical cord therethrough and a smaller, lateral retention portion sized to receive a wire portion of the electrical cord therein, where the retention portion is configured to align along an axis of the port.

In accordance with a third aspect, a retention assembly for securing a first end of an electrical cord to a power outlet of a vehicle is described herein. The retention assembly includes a housing having an interior sized to receive a first end of an electrical cord therein with a plug portion of the first end received within a port electrically coupled to a power outlet. The housing includes a front wall defining a front opening and a sidewall extending rearwardly from a first end at the front wall to a second end that defines a rear opening sized to extend around the power outlet of the vehicle. The assembly further includes an insert sized to fit within the interior of the housing that includes a plug portion with a front wall configured to fit within the front opening of the housing, a shoulder extending outwardly from the plug portion configured to abut the front wall with the insert disposed within the housing, and a sidewall extending from the shoulder to a rear edge. A slot opening of the insert has a first end in the front wall and a second end open through the rear edge of the sidewall. The slot opening is sized to receive a wire portion of the electrical cord therethrough to position the first end within the insert.

According to some forms, the assembly can include one or more of the following aspects: the first end of the slot opening can align along an axis of the port; the housing can include a flange projecting outwardly from an intermediate portion thereof, where the flange includes one or more slot openings extending therethrough sized to retain a wire portion of the electrical cord inserted therein; or the assembly can include a spacer configured to engage a wire portion of the electrical cord and be sized to span a majority of a gap between the first end of the electrical cord and the front wall of the insert, where, in further forms, the spacer can have an annular body with a longitudinal slit extending therethrough to be coupled around the wire portion of the electrical cord.

According to some forms, the housing can include a protrusion extending outwardly from the second end of the sidewall having a bore therethrough to receive a fastener and secure the housing to a structure of the vehicle. In further forms, the housing can include a tab projecting outwardly and rearwardly from the second end of the sidewall opposite the protrusion, where the housing is configured to be secured to the structure of the vehicle by inserting the tab into an opening and subsequently inserting a fastener through the bore; or the assembly can include a mounting base having a bore configured to align with the bore of the protrusion and receive a fastener therein to secure the housing to the mounting base.

According to some forms, the retention housing can include a rear portion sized to extend around portions of an adapter projecting from the power outlet and a forward portion sized to extend around the insert and the first end of the electrical cord. In further forms, the sidewall of the insert can extend between the adapter and the front wall of the housing and/or the sidewall of the insert can be complementary to the sidewall of the forward portion of the housing.

In accordance with a fourth aspect, a retention assembly for securing a first end of an electrical cord to a power outlet of a vehicle is described herein. The retention assembly includes an adapter having a port on a proximal end configured to receive a plug portion of a first end of an electrical cord therein and a plug on a distal end configured to electrically couple with a power outlet. The retention assembly further includes a housing having an interior sized to receive the first end of the electrical cord and portions of the adapter therein with the plug portion inserted into the port and the adapter inserted into the power outlet. The housing includes a front wall defining a front opening and a sidewall extending rearwardly from a first end at the front wall to a second end defining a rear opening sized to extend around the power outlet of the vehicle. The housing further includes a rear portion sized to extend around portions of the adapter projecting from the power outlet and a forward portion sized to extend around the first end of the electrical cord. The retention assembly further includes an insert sized to fit within the forward portion of the housing that includes a plug portion with a front wall, a shoulder extending outwardly from the plug portion, and a sidewall extending from the shoulder to a rear edge. With this configuration, when the insert is received within the forward portion of the housing, the plug portion is disposed within the front opening, the shoulder abuts the front wall, and the rear edge is adjacent to the proximal end of the adapter. A slot opening of the insert has a first end in the front wall and a second end open through the rear edge of the sidewall and the slot opening is sized to receive a wire portion of the electrical cord therethrough to position the first end within the insert.

According to any of the above forms, the adapter can be a 12V auxiliary charger for vehicle 12V power outlets.

BRIEF DESCRIPTION OF THE DRAWINGS

The above needs are at least partially met through provision of the plug retention embodiments described in the following detailed description, particularly when studied in conjunction with the drawings, wherein.

DETAILED DESCRIPTION

Figure 1:
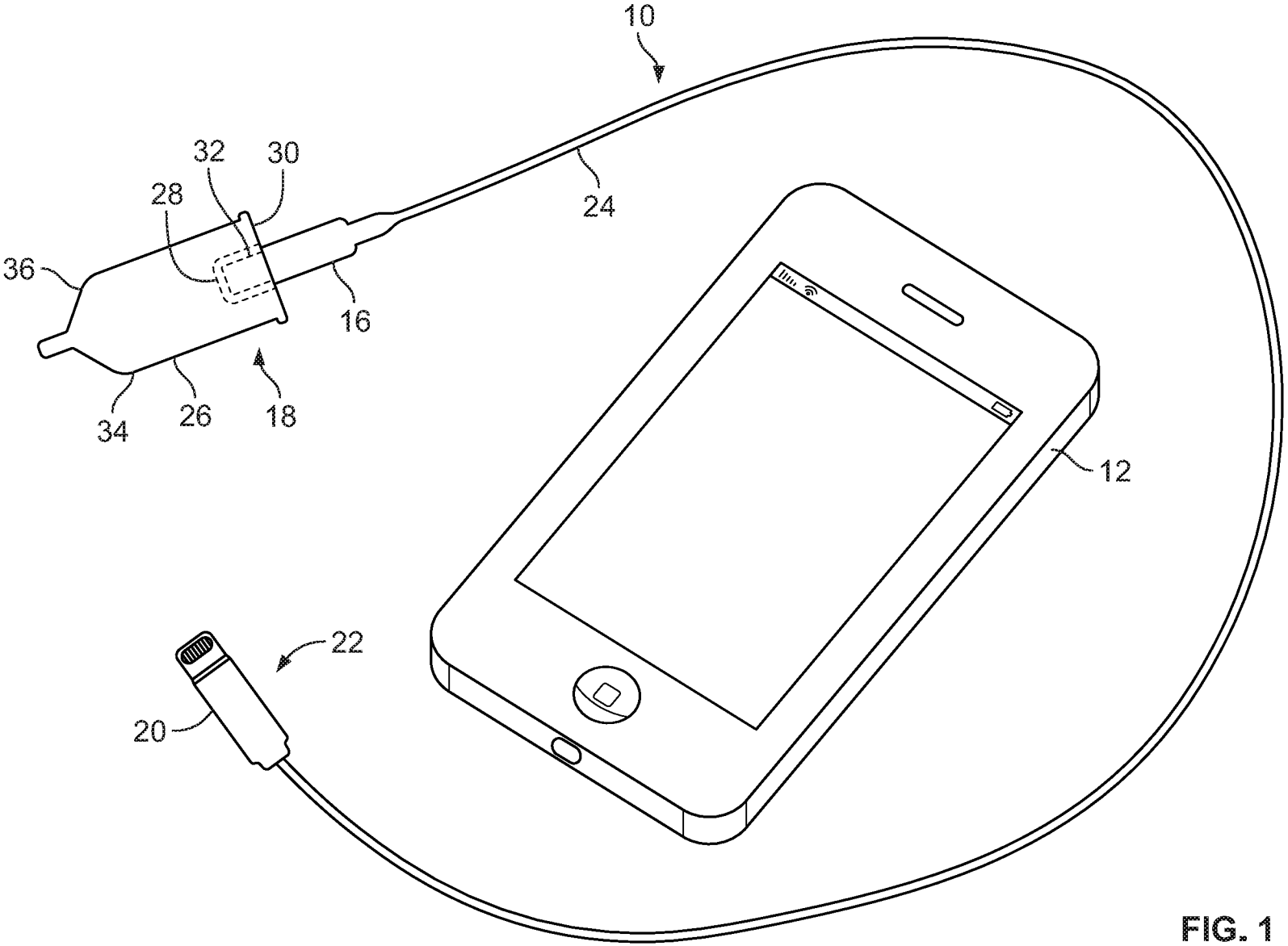
FIG. 1 is a top plan view of an electrical cord, adapter plug, and electrical device in accordance with various embodiments of the present disclosure.

Retention components are described herein configured to couple to structure adjacent to a vehicle's 12V auxiliary power outlet (i.e., cigarette lighter outlet) to thereby retain power cord(s) in electrical engagement with the auxiliary outlet via a conventional 12V power plug with USB connector port. The retention components can be secured to the structure using any suitable mechanism, such as by using fastener(s), adhesive, snap fit, tongue and groove, threaded connection, and so forth. The retention components can be configured to retain power cords in electrical connection with any 12V power outlet of a vehicle such as car, boat, truck, RV, camper, etc., including outlets in dashboards, glove boxes, center consoles, trunks, and so forth. The retention components have a housing defining an interior shaped and sized to receive a plug of the power cord therein. The housing includes an opening in an outwardly facing surface to both receive the power cord therethrough and retain a wire of the power cord so that the housing can be secured to the structure and the connector of the power cord be held generally immobile within the housing.

A retention assembly is provided herein having a housing configured to retain a first, plug end of an electrical cord and an adapter to electrically couple the plug end of the electrical cord to a power outlet, such that with the housing secured to a vehicle structure, the plug end of the electrical cord and the adapter is retained between the power outlet and the housing, thereby preventing one from walking away from the wall with the entire electrical cord or adapter. The housing includes an interior sized to receive the plug end and adapter therein. In some versions, an end wall of the housing includes a through-opening having an assembly portion to allow an end of the electrical cord to pass therethrough to connect the first end to the adapter and a retention portion sized to receive a middle, wire portion of the electrical cord therein. In other versions, the retention assembly includes an insert having a slot opening to receive the wire portion of the electrical cord therethrough. The insert can then be inserted into the housing such that a sidewall of the insert extends between a front wall of the housing and the adapter to restrict movement of the first end and the adapter.

While the depicted form of the retention feature is designed and configured to accommodate standard vehicle 12V auxiliary outlet charging connectors for smart phones, tablets, PCs and other mobile or immobile devices with one or more USB ports, the retention feature could be easily modified to accommodate other power supplies. That is, most charging cords for mobile devices include a first end with a first connector for connecting to a charging or power source such as a vehicle accessory power outlet, and a second end with a second connector for plugging into a device to be charged. However, due to the proliferation of mobile devices and the need for electrically charging these devices, recent trends in electrical supply include providing USB ports in addition to or as a substitute for one of the traditional vehicle 12V auxiliary power outlets. This advantageously enables users to plug the first end of the charging cord, which includes the USB connector, directly into the USB outlet without requiring a power adapter. Thus, it should be appreciated that the present invention can be easily modified to accommodate this variation.

Figure 3:
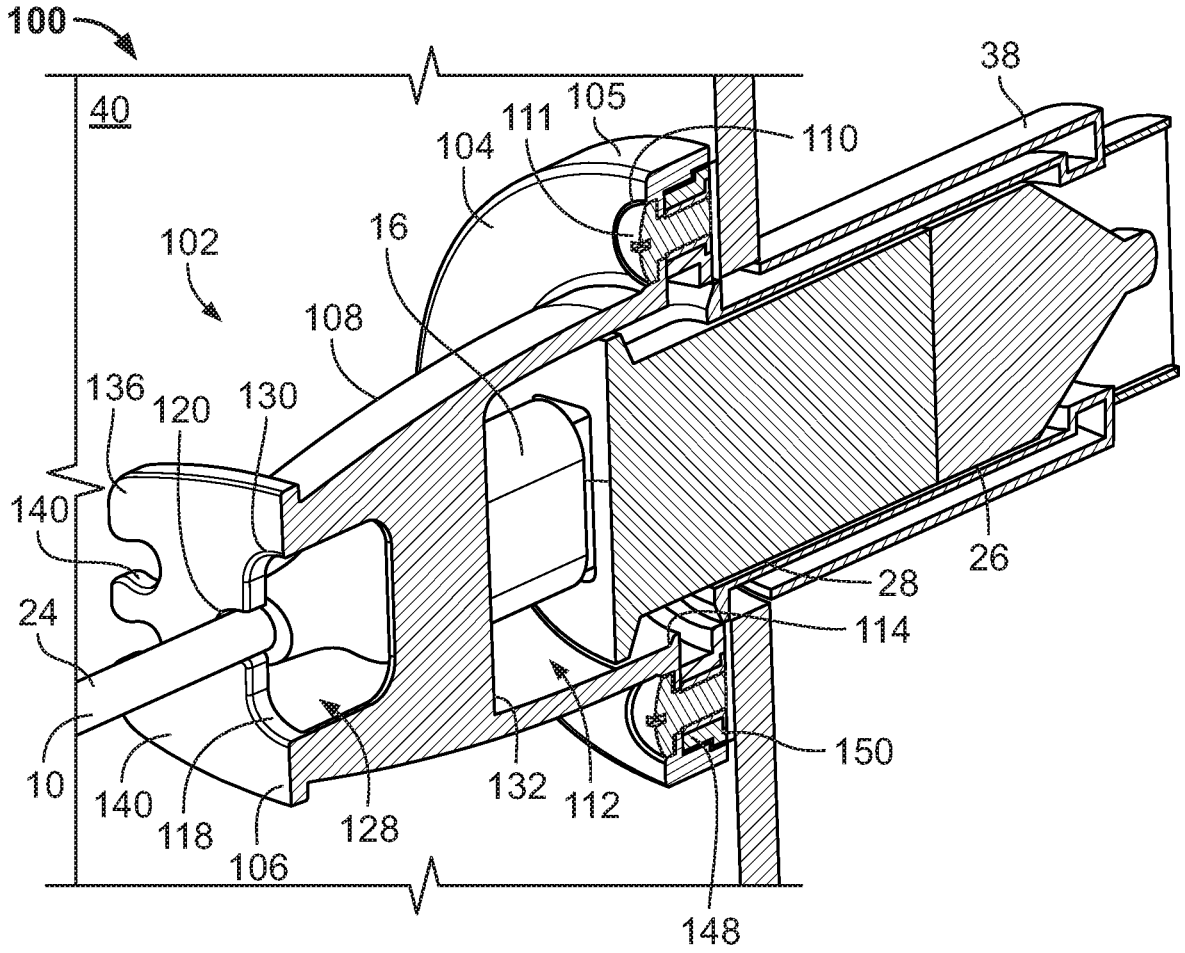
FIG. 3 is a cross-sectional view of the retention assembly of FIG. 2.
Figure 9:
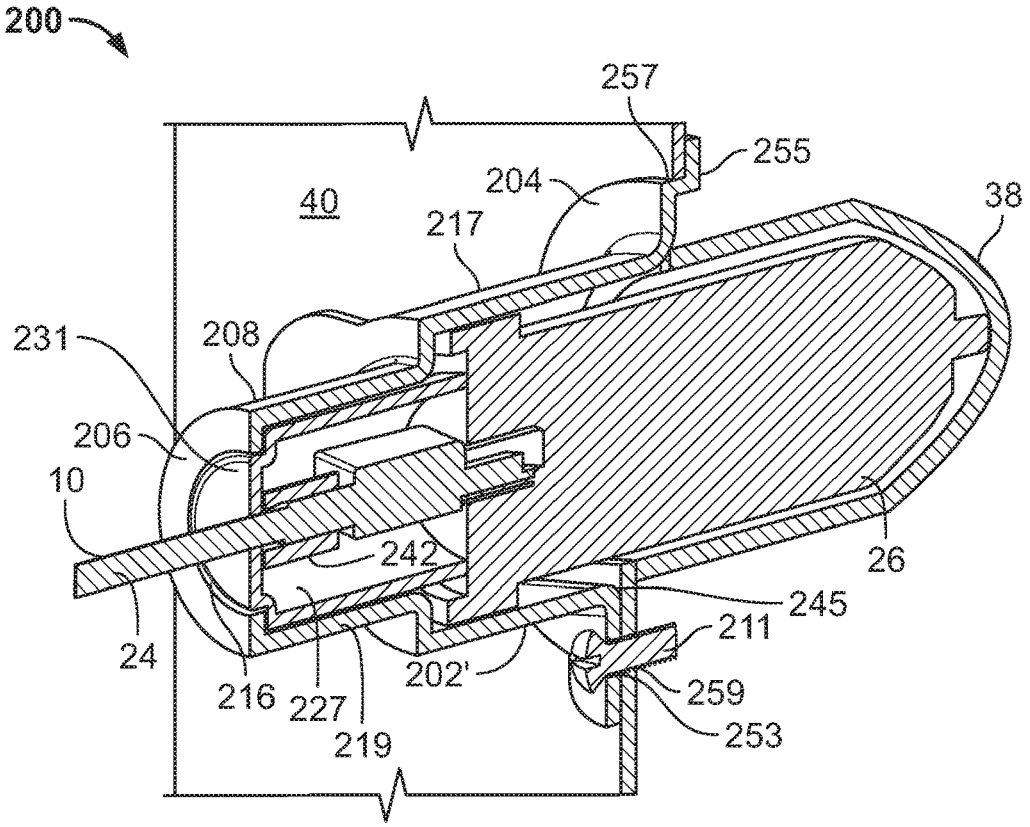
FIG. 9 is a cross-sectional view of a third example retention assembly including a housing and insert mounted over an adapter disposed within an accessory outlet with a first end of an electrical cord received therein in accordance with various embodiments of the present disclosure.

Referring now to the figures, an example electrical cord 10 for connecting an electrical device 12 to a power source or secondary electrical device 38 is shown in FIGS. 1, 3, 7, and 9. The power source 38 can be a conventional cylindrical bore shaped 12V auxiliary outlet (FIGS. 3 and 9). The electrical cord 10 includes a first connector or plug 16 at a first end 18 thereof, a second connector or plug 20 at a second, opposite end 22 thereof, and a wire portion 24 extending therebetween. With many configurations, the first connector 16 has larger dimensions than the second connector 20, and both the first and second connectors 16, 18 have larger dimensions than the wire portion 24. For example, the second connector 20 can be a Lightning or mini-USB connector, while the first connector 16 can be a USB connector. Of course, other connectors and plugs for the first and second connectors 16, 20 can also be utilized.

Referring to FIG. 1, for some power supplies, the electrical cord 10 can utilize an adapter 26 at the first end 18 thereof. The adapter 26 includes one or more ports 28 on a first side 30 thereof configured to couple to a plug portion 32 of the first connector 16 and a cylindrical plug 34 on a second side 36 thereof. The adapter 26 in some versions is a conventional 12V auxiliary power plug configured to plug into conventional cylindrical bore shaped 12V auxiliary outlet 38 (FIGS. 3 and 9) and the plug 34 can have a corresponding cylindrical configuration with distal and side electrical connections. Of course, the plug 34 can have any desired configuration corresponding to the power supply or secondary electrical device 14. Moreover, as mentioned above, some versions do not require the adapter 26 at all such that the USB plug portion 32 of the first connector 16 plugs directly into a complementary USB charging outlet.

Figure 4:
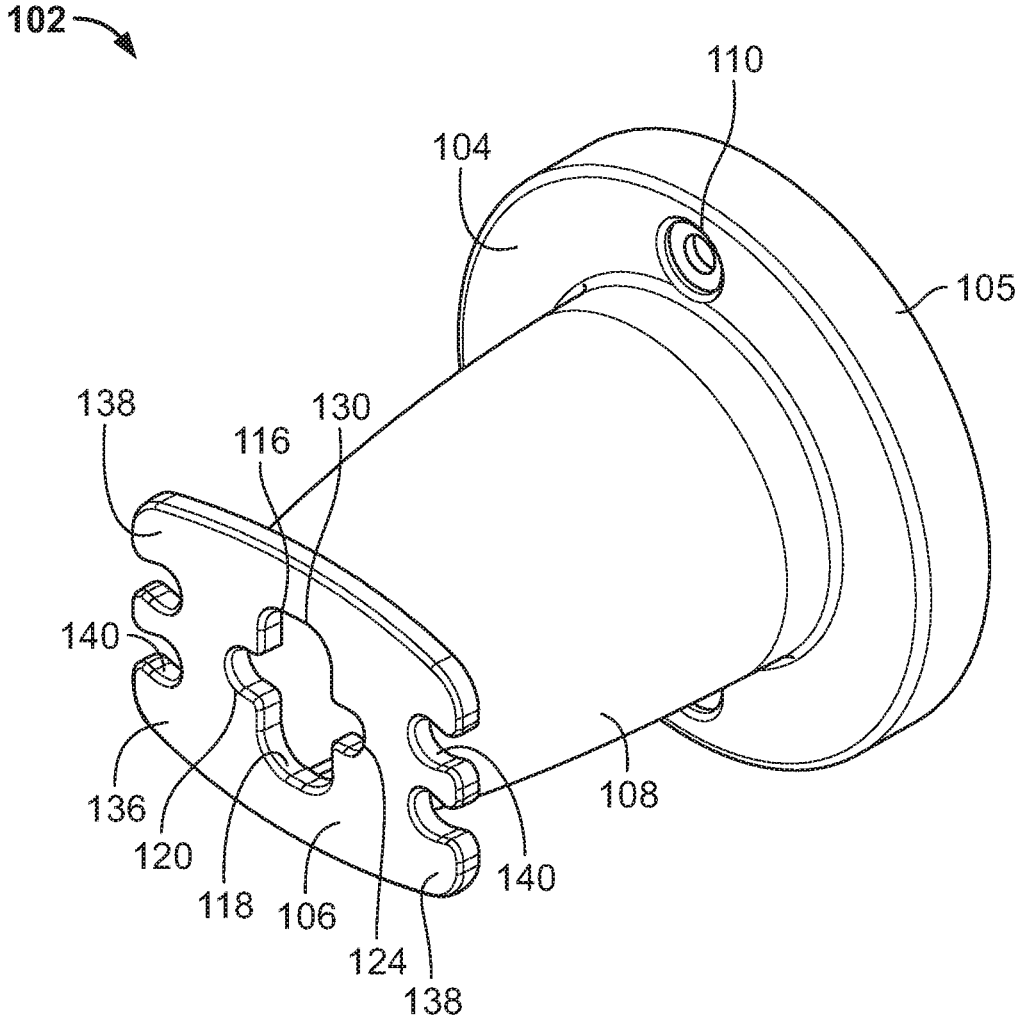
FIG. 4 is a perspective view of the housing of the retention assembly of FIG. 2.

One embodiment of a cord retention assembly 100 for a vehicle or other power outlet is shown in FIGS. 2-6. The assembly 100 includes a retention housing 102 having an outwardly extending rear flange 104 with a rearwardly extending skirt 105, a front wall 106, and a sidewall 108 extending between the front wall 106 and the flange 104. The retention housing 102 defines an interior 112 sized to receive one or more first ends 18 of electrical cords 10 and, if applicable, portions of the adapter 26 therein. The skirt 105 extends around a rear opening 114 to the interior 112 that is sized and configured to extend around the outlet 38 so that the adapter 26 and the first end 18 can be electrically coupled thereto. The flange 104 can include one or more openings 110 extending therethrough each sized to receive a fastener 111 to secure the housing 102 adjacent to the outlet 38, such as to structure of the outlet 38, a wall or other vehicle structure 40 extending around the outlet 38, and so forth. The fasteners 111 can have any desired drive type, such as square, hex, slotted, Phillips, Torx, spline, and the like. As shown, the general shape of the housing 102 is cylindrical to accommodate and correspond to the general shape of convention 12V vehicle auxiliary outlets and, more particularly, the rear flange 104 and skirt 105 are annular rings, the sidewall 108 is a tapered cylindrical shape with slight convexity, and the front wall 106 is generally rectangular with other geometrical features, as will be described. In some versions, the sidewall 108 is a half-barrel shape with a convex taper as the sidewall 108 extends from the flange 104 to the front wall 106. Additionally, while the rear flange 104 and skirt 105 are illustrated as continuous unbroken rings, other versions of the housing 102 can include sections removed to facilitate attachment to power outlets 38. The front wall 106 includes a front opening 116 extending therethrough so that portions of the electrical cord 10 can be inserted into the housing interior 112. As shown in FIG. 4, the front opening 116 includes an assembly portion 118 and a smaller, retention portion 120. The assembly portion 118 is relatively larger than the retention portion 120 and sized to receive one or both of the first or second ends 18, 22 of the electrical cord 10 therethrough so that the electrical cord 10 can be assembled with the housing 102 prior to securing the housing 102 to the vehicle or other substrate. If desired, the assembly portion 118 can have a shape, such as rectangular as shown, so that the first and/or second ends 18, 22 of the electrical cord 10 can only pass therethrough in a corresponding orientation. For example, in the illustrated form, the assembly portion 118 has a rectangular configuration, which can be generally complementary to a shape of the first and/or second ends 18, 22 of the electrical cord 10, with the rectangle having a larger vertical dimension than horizontal dimension. So configured, a user can insert one of the first or second ends 18, 22 through the assembly portion 118 of the front opening 116 with the end 18, 22 oriented vertically.

Conversely, the relatively smaller retention portion 120 is sized to receive the wire portion 24 therein while also having at least one dimension smaller than a corresponding dimension of the first and second ends 18, 22 and, in some forms, multiple dimensions, e.g., width and/or height. So configured, with the wire portion 24 received within the retention portion 120 of the front opening 116, the first end 18 of the electrical cord 10 cannot be pulled from the housing 102. In the illustrated form, the housing 102 can be sized to receive two cord first ends 18 therein and the front opening 116 includes two corresponding retention portions 120 that extend laterally from opposite sides 122 of the rectangular assembly portion 118 to a dome-shaped end 124. The dome-shaped end 124 can have a diameter generally, e.g., within 0 to 2 mm, equal to a diameter of the wire portion 24 of the electrical cord 10. In one form, the retention portion 120 can be sized to receive the wire portion 24 therein in a friction fit.

Figure 5:
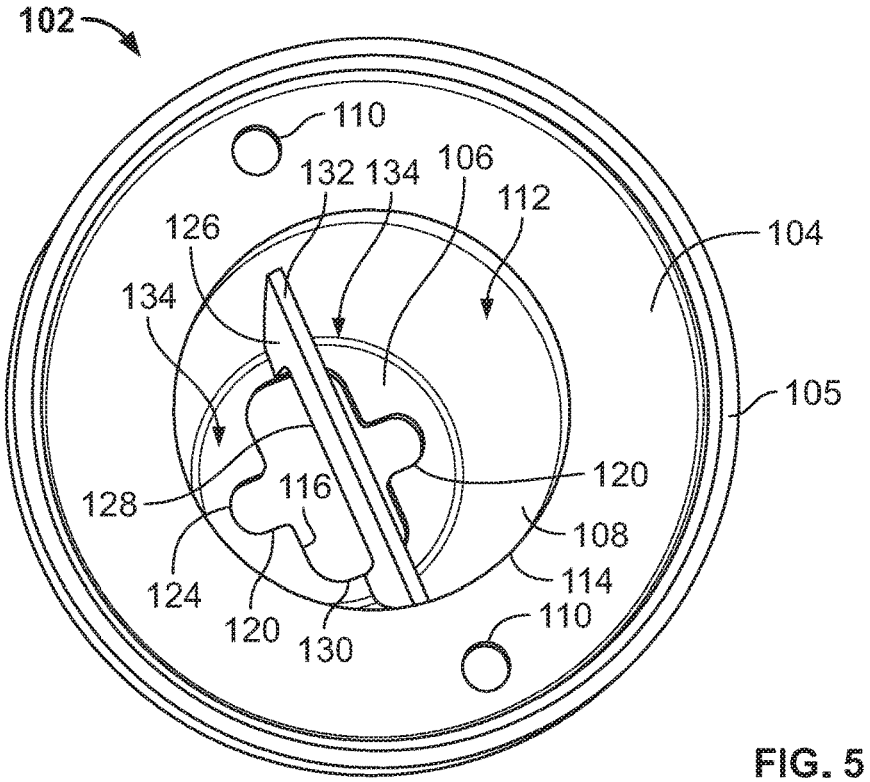
FIG. 5 is a rear perspective view of the housing of the retention assembly of FIG. 2.

As shown in FIGS. 3 and 5, the housing 102 can include a divider wall 126 extending between opposing portions of the sidewall 108 that separates and restricts movement of the cord first ends 18 disposed within the interior 112. The divider wall 126 can be positioned generally centrally across the interior 112 so that the wall 126 aligns with the front opening 116 and, specifically, the assembly portion 118 thereof. To allow the first ends 18 to be inserted through the front opening 116 and positioned within the interior 112, the divider wall 126 can define a window 128 adjacent to the front wall 106 that connects with end edges 130 of the assembly portion 118. In order to save material costs, the divider wall 126 can extend along a portion of the sidewall 108 rather than the entire length so that a rear edge 132 is spaced from a rear edge of the sidewall 108. In the illustrated form, the divider wall 126 extends from the front wall 106 to about halfway along the sidewall 108. Advantageously, the divider wall 126 and the sidewall 108 together define a compartment 134 sized to receive the first end 18 therein. In one form, dimensions, e.g., a height and/or width, of the compartment 134 can be slightly larger, e.g., about 1 to 10 mm, about 1 to 5 mm, about 2 to 3 mm, etc., than corresponding dimensions of the first connector 16. So configured, the compartment 134 can restrict the first end 18 from lateral, vertical, and rotational movement during use.

Figure 6:
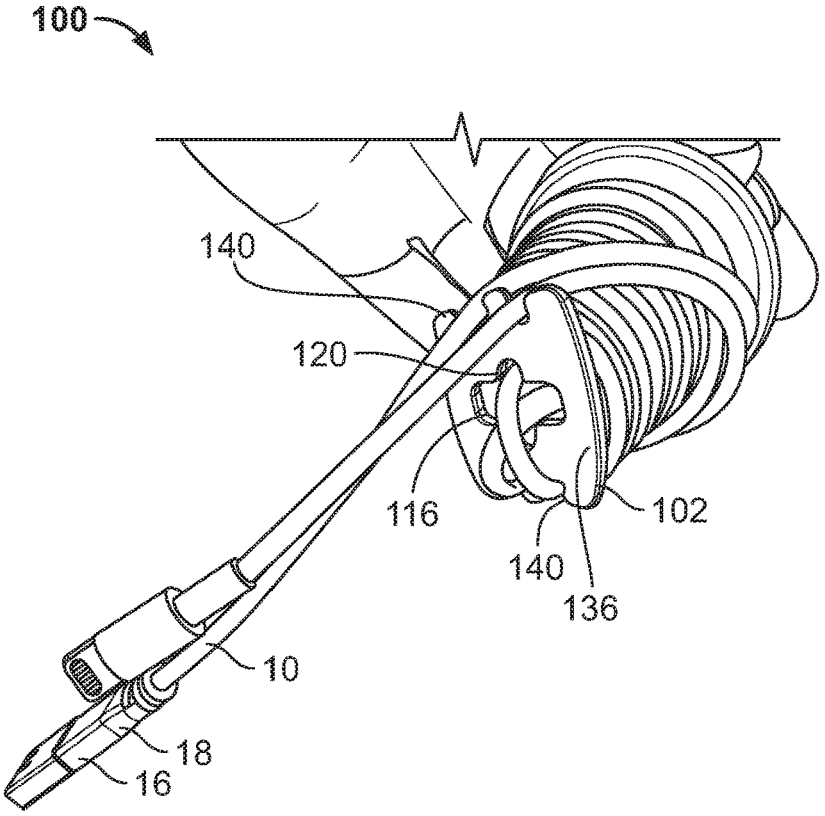
FIG. 6 is a perspective view of the retention assembly of FIG. 2 having first ends of electrical cords received therein and wire portions wrapped therearound.

The front wall 106 can also include an outwardly projecting flange 136 to provide a storage feature for the wire portion 24, and potentially a convenient grip for a user when installing the housing 102. In the depicted form, the flange 136 extends in a plane that is perpendicular to a longitudinal or central axis of the generally cylindrically shaped sidewall 108. In the illustrated form, the flange 136 includes relatively larger oppositely disposed lateral portions 138 with one or more slots 140 that are sized, similar to the retention portions 120 of the front opening 116, to frictionally retain the wire portion 24 of the electrical cord 10 therein. With this configuration, as shown in FIG. 6, a user can wrap the wire portion 24 around the sidewall 108 of the housing 102 when not in use (or to shorten the usable length of the wire portion 24) and the flange 136 and slots 140 can retain the wire portion 24 in a wrapped configuration. That is, the presence of the flange 136 helps prevent the wrapped wire from easily sliding off of the front of the housing 102.

In some embodiments, and as mentioned, the housing 102 can be configured for particular adapter 26 shapes and sizes. For example, a cross-section of the housing 102, taken along a plane generally orthogonal to the longitudinal or central axis of the sidewall 108 thereof, can be have dimensions slightly larger than a corresponding cross-section of the adapter 26. In the illustrated form, the adapter 26 has a generally cylindrical configuration with a circular cross-section. Accordingly, in the illustrated form, the sidewall 108 has a tubular configuration defining an internal cylindrical bore and such that the housing 102 has a circular cross-section and the rear opening 114 is circular to extend around the circular opening to the vehicle outlet 38. If desired, the interior 112 of the housing 102 can have a circular cross-section that is slightly larger, e.g., about 1 to 10 mm, about 1 to 5 mm, about 2 to about 3 mm, etc., than the adapter 26. In versions where the outlet 38 includes USB ports for the cord's first end 18, the sidewall 108 of the housing 102 can have a relatively shorter longitudinal length to compensate for the lack of the need for an adapter 26 projecting into the housing interior 112. In such configuration, however, the sidewall 108 could remain generally cylindrical or any other shape as desired.

As discussed above, a user can insert one of the ends 18, 22 through the assembly portion 118 of the front opening 116 to assemble the cord 10 to the housing 102. Thereafter, the user can plug the first connector 16 into the port 28 of the adapter 26 and the adapter 26 into the outlet 38. If desired, and the adapter 28 or power outlet 38 includes two ports 28, the user can then assemble a second cord 10 to the housing 102 in a similar fashion. Next, the user can slide the housing 102 along the cords 10 until the first ends 18 are received within their respective compartments 134 in the housing 102 and then insert the wire portions 24 of the electrical cords 10 into the retention portions 122 of the front opening 118. Advantageously, the front opening 116 can be disposed within the front wall 106 so that the retention portions 120 align with axes of the ports 28 in the adapter 26 or power outlet 38. Finally, the user can secure the housing 102 to the vehicle structure 40 (i.e., interior trim components) around the power outlet 38 using the fasteners 111 or any other mechanism mentioned herein or otherwise known to those skilled in the art.

For some first ends 18, the housing 102 will be sized to restrict withdrawal of the plug portion 32 from the adapter/power outlet port 28. In cases where the first connector 16 has a relatively smaller depth such that the connector 16 is spaced from the front wall 106, however, the space between the first connector 16 and the front wall 106 may undesirably allow a user to unplug or break an electrical connection between the first connector 16 and the adapter 26. Advantageously, the assembly 100 can be provided with spacers 142 that are configured to engage the electrical cord 10 to span a majority of the distance between the first end 18 and the end wall 116, restricting movement of the cord 10 away from the adapter 26. For example, the spacer 142 can extend 75%, 85%, 95%, or 99% of the distance. In another example, the spacer 142 can be sized so that there is minimal, e.g., between 0 and about 5 mm, between 0 and about 3 mm, or between 0 and about 2 mm, gap available for the first end 18 to move. The spacers 142 can have an annular body 144 with a longitudinal slit 146 allowing a user to insert the wire portion 24 of the electrical cord 10 into the annular body 144. Thereafter, the user can position the first end 18 in the compartment 134 and secure the housing 102 to the vehicle structure 40. In one example, the assembly 100 can be provided with spacers 142 having a range of depths so that any particular electrical cord 10 can be accommodated within the housing 102 with satisfactory results.

Figure 2:
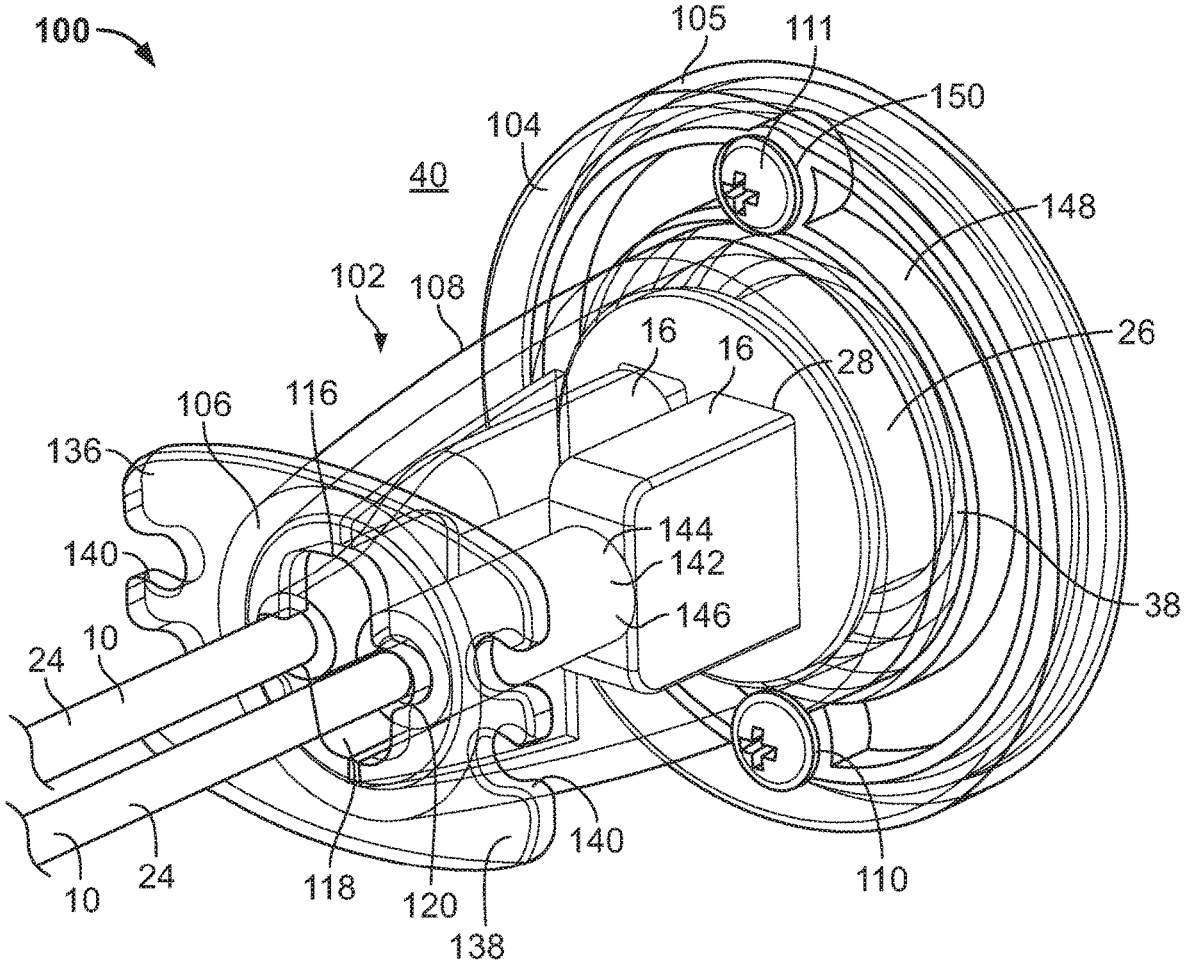
FIG. 2 is a perspective view of a first example retention assembly including a housing mounted over an adapter disposed within an accessory outlet with a first end of an electrical cord received therein in accordance with various embodiments of the present disclosure.

In some cases, a user may prefer not to screw the fasteners 111 directly into the vehicle structure 40. In such cases, the assembly 100 can be provided with a mounting base 148 (as shown in FIG. 3, for example) having a shape and footprint complementary to the flange 104 and skirt 105 so that the housing 102 can be disposed on and secured to the mounting base 148. In the illustrated form, the mounting base 148 has an annular body sized to extend around the outlet 38 with an outer diameter to fit within the diameter of the skirt 105 and a depth to engage the flange 104. Further, as shown in FIG. 2, the mounting base 148 includes bores 150 configured to align with the openings 110 in the flange 104. A user can then secure the mounting base 148 to the vehicle structure 40 around the outlet 38 using an adhesive or the like and secure the housing 102 to the mounting base 148 with the fasteners 111 to thereby retain the first ends 18 in electrical engagement with the adapter 26 and/or outlet 38.

Figure 7:
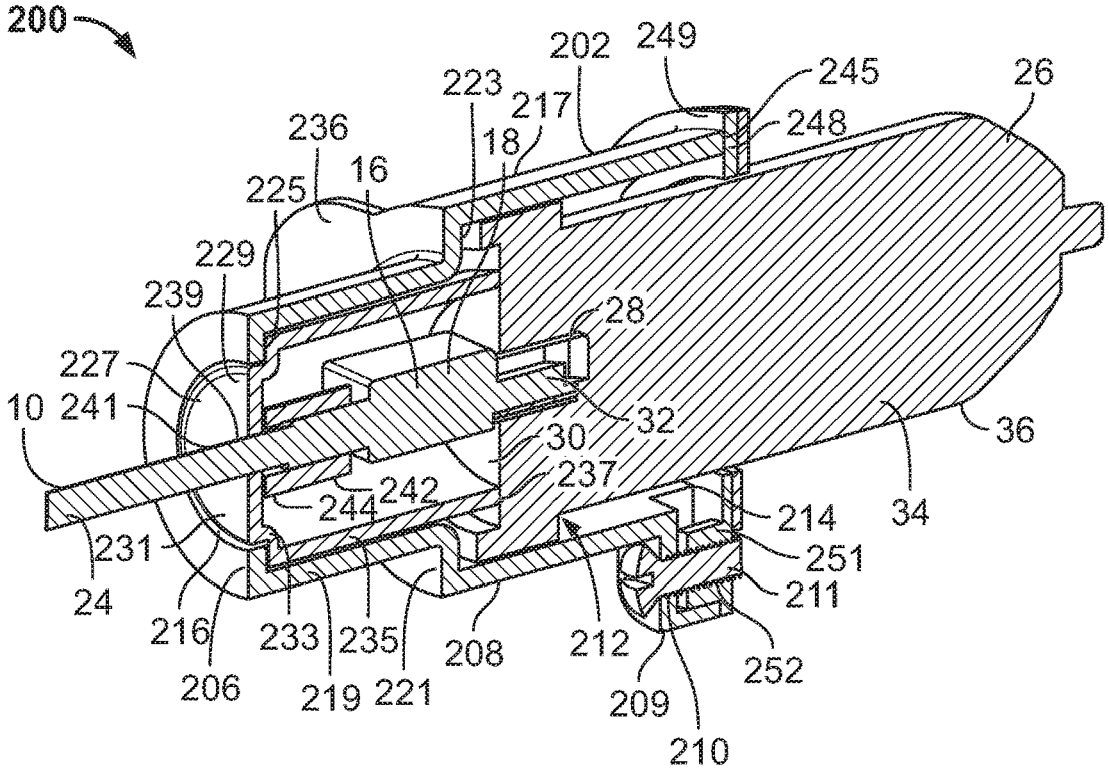
FIG. 7 is a cross-sectional view of a second example retention assembly including a housing and insert mounted over an adapter disposed within an accessory outlet with a first end of an electrical cord received therein in accordance with various embodiments of the present disclosure.
Figure 8:
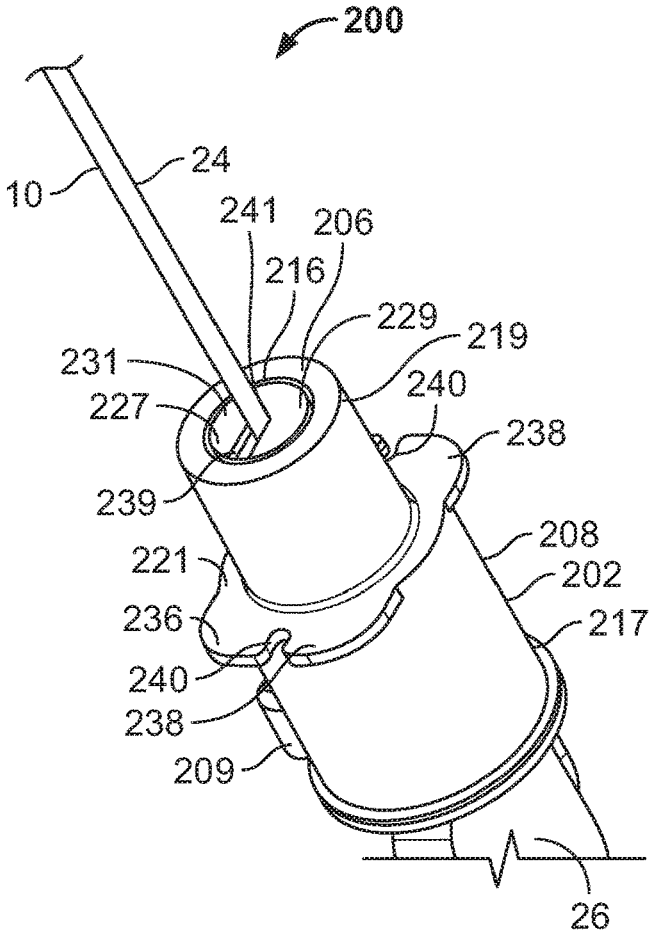
FIG. 8 is a perspective view of the retention assembly of FIG. 7.

Another embodiment of a cord retention assembly 200 for a vehicle or other power outlet is shown in FIGS. 7 and 8. The assembly 200 includes a retention housing 202 having a front wall 206 defining a front opening 216 therethrough and a sidewall 208 extending rearwardly from the front wall 206. Similar to the assembly previously described, the assembly 200 in FIGS. 7 and 8 is generally cylindrical in shape to accommodate and correspond to a conventional 12V vehicle auxiliary power outlet and 12V auxiliary charging plug. The retention housing 202 defines an interior 212 sized to receive the first end 18 of the electrical cord 10 and, if applicable, portions of the adapter 26 therein. The sidewall 208 extends around a rear opening 214 to the interior 212 that is sized and configured to extend around the outlet 38 so that the adapter 26 and the first end 18 can be electrically coupled thereto. The sidewall 208 can include one or more protrusions 209 having openings 210 extending therethrough each sized to receive a fastener 211 to secure the housing 202 adjacent to the outlet 38, such as to structure of the outlet 38, a wall or other vehicle structure 40 extending around the outlet 38, and so forth. The fasteners 211 can have any desired drive type, such as square, hex, slotted, Phillips, Torx, spline, and the like.

In some versions, the housing 202 can include a rear portion 217 for reception of a portion of the adapter 26 projecting outwardly from the outlet 38 and a forward portion 219 extending from the rear portion 217 for reception of the first end 18 of the electrical cord 10. As shown, the housing 202 can have a stepped configuration with a shoulder portion 221 extending between the rear portion 217 and the dimensionally smaller forward portion 219. As such, the interior 212 of the housing 202 includes a stop surface 223 on an interior of the shoulder 221 that is configured to abut the first side 30 of the adapter 26 during use, preventing the adapter 26 from becoming unconnected from the outlet 38. If desired, the depth of the rear portion 217 between the stop surface 223 and the vehicle structure 40 can be slightly larger, e.g., about 1 to 10 mm, about 1 to 5 mm, about 2 to about 3 mm, etc., than a depth of the adapter 26 projecting out of the outlet 38.

The rear portion 217 can be configured for particular adapter 26 shapes and sizes. For example, a cross-section of the housing 202, taken along a plane generally orthogonal to the depth thereof, can be have dimensions slightly larger than a corresponding cross-section of the adapter 26. In the illustrated form, the adapter 26 has a generally cylindrical configuration with a circular cross-section. Accordingly, in the illustrated form, the sidewall 208 in the rear portion 217 thereof has a tubular configuration such that the housing 202 has an annular cross-section and the rear opening 214 is circular to extend around the circular opening to the vehicle outlet 38. If desired, the interior 212 of the housing 202 in the rear portion 217 can have a circular cross-section that is slightly larger, e.g., about 1 to 10 mm, about 1 to 5 mm, about 2 to about 3 mm, etc., than the adapter 26. In versions where the outlet 38 includes ports for the cord first end 18, the housing 202 can be provided without the rear portion 217 and the protrusion(s) 209 can extend from the forward portion 219.

The forward portion 219 extends from the shoulder 221 and has a tubular configuration with an annular cross-section taken along a plane generally orthogonal to the depth thereof. As discussed above, the front wall 206 defines the front opening 216 so that a user can access the housing interior 212 and insert one of the first or second ends 16, 22 of the cord 10 therethrough. In the illustrated form, the front wall 206 has an annular shape providing a lip 225 extending around the opening 216.

In order to retain the first end 16 in the housing 102, the assembly 100 of this form includes an insert 227 sized to fit within the forward portion 219 of the housing 202 and extend between the front wall 206 and the adapter 26. The insert 227 includes a plug portion 229 having a front wall 231, a shoulder 233 extending outwardly from the plug portion 229, and a sidewall 235 extending rearwardly from the shoulder 233 to a rear edge 237. The plug portion 229 is sized to be inserted into the front opening 216 so that the front wall 206 thereof is generally planar with the front wall 206 of the housing 102 and the shoulder 233 abuts the lip 225 of the front wall 206. Further, the sidewall 235 can be sized to extend the entire distance between the front wall 206 and the adapter 26 or can be spaced slightly, e.g., between about 1 mm to about 3 mm therefrom, where the insert 227 still prevents the adapter 26 from being disconnected from the outlet 38. As shown in FIG. 8, the insert 227 includes a slot opening 239 with one end 241 generally centrally located in the front wall 231. The slot opening 239 extends downwardly from the front wall 231, along the sidewall 208 to a second end opening through the rear edge 237 of the sidewall 235. In some versions, the first end 241 of the slot opening 239 aligns with an axis of the adapter 26 and/or power outlet 38. In further versions, the first end 241 of the slot opening 239 is located generally centrally in the front wall 231. In the illustrated form, the front wall 231 is circular and the sidewall 235 has a tubular configuration with an annular cross-section.

With this arrangement, a user can insert the first end 18 of the wire 10 through the front opening 216 of the housing 102 and slide the wire portion 24 of the cord 10 within the slot opening 239 of the insert 227 until the wire portion 24 extends through the first end 241 thereof. Thereafter, the user can plug the first connector 16 into the port 28 of the adaptor 26 and plug the adaptor 26 into the power outlet 38. Then, the user can position the housing 202 over the insert 227, the first end 18, and the adapter 26 and secure the housing 202 to the vehicle structure 40 using the fastener 211.

In some cases, a user may prefer not to screw the fasteners 211 directly into the vehicle structure 40. In such cases, the assembly 200 can be provided with a mounting base 248 having an annular shape and footprint with an upper surface 249 sized to receive a rear edge 245 of the sidewall 208 thereon and a protrusion 251 complementary to the protrusion 208 of the housing 202. Further, as shown in FIG. 7, the protrusion 251 can include a bore 252 configured to align with the openings 210 in the protrusion 208. A user can then secure the mounting base 248 to the vehicle structure 40 around the outlet 38 using an adhesive or the like and secure the housing 202 to the mounting base 248 with the fasteners 211 to thereby retain the first ends 18 in electrical engagement with the adapter 26 and/or outlet 38.

For some first ends 18, the forward portion 219 of the housing 202 and the insert 227 will be sized to restrict withdrawal of the plug portion 32 from the adapter port 28. In cases where the first connector 16 is smaller than a depth of the forward portion 219 and the insert 227, however, the space between the first connector 16 and the insert front wall 231 may undesirably allow a user to unplug or break an electrical connection between the first connector 16 and the adapter 26. Advantageously, the assembly 200 can be provided with spacers 242 that are configured to engage the electrical cord to span a majority of the distance between the first end 18 and the front wall 231, restricting movement of the cord 10 away from the adapter 26. For example, the spacer 242 can extend 75%, 85%, 95%, or 99% of the distance. In another example, the spacer 242 can be sized so that there is minimal, e.g., between 0 and about 5 mm, between 0 and about 3 mm, or between 0 and about 2 mm, gap available for the first end 18 to move. The spacers 242 can have an annular body 244 with a longitudinal slit allowing a user to insert the wire portion 24 of the electrical cord 10 into the annular body 244. Thereafter, the user can position the first end 18 in the insert 227 and the insert 227 in the forward portion 219, and secure the housing 202 to the vehicle structure 40. In one example, the assembly 202 can be provided with spacers having a range of depths so that any particular electrical cord 10 can be accommodated within the insert 219 with satisfactory results.

As shown in FIG. 8, the retention housing 208 can further include a flange 236 that projects outwardly from all or portions of the sidewall 208 to provide a convenient grip for a user when installing the housing 202. In the illustrated form, the flange 236 projects from sides of the housing 202 aligned with the shoulder 221. Of course, the flange 236 can be disposed at other depths of the housing 202. In the illustrated form, the flange 236 includes relatively larger lateral portions 238 with one or more slots 240 that are sized, similar to the above described slots 140, to frictionally retain the wire portion 24 of the electrical cord 10 therein. With this configuration, a user can wrap the wire portion 24 around the housing 202 when not in use and the flange 236 and slots 240 can retain the wire portion 24 in a wrapped configuration.

Figure 10:
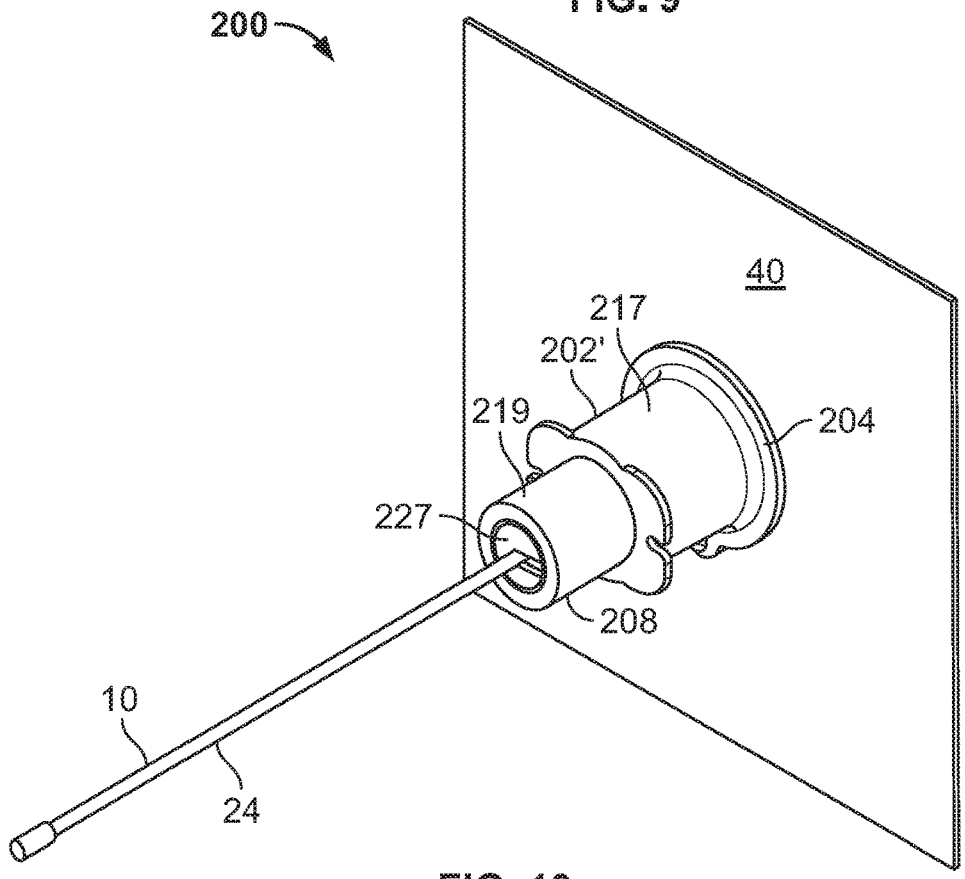
FIG. 10 is a perspective view of the retention assembly of FIG. 9.

An alternative version of a housing 202' for the assembly 200 is shown in FIGS. 9 and 10. In this form, the housing 202' includes a rear flange 204 extending outwardly from the rear edge 245 of the sidewall 208. The flange 204 includes an opening 253 extending therethrough to receive a fastener 211 and, generally opposite to the opening 253, a tab 255 that projects outwardly and rearwardly from the flange 204. As shown in FIG. 9, the vehicle structure 40 can include an opening 257 sized to receive the tab 255 and a bore 259 configured to align with the opening 253. With this arrangement, a user can insert the tab 255 into the opening 257 and insert a fastener 211 through the flange 204 and into the bore 259 to thereby secure the housing 202 to the vehicle structure 40.

In some versions, the outlet 38 may include a cover attached thereto by a hinge. It will be understood that the housings 102, 202, 202' described herein can be readily modified with recesses in the sidewall 108, 208 at the edge thereof to receive the hinge therethrough, so that the cover can be disposed outside of the housing 102, 202, 202' when the housing 102, 202, 202' is secured to the vehicle structure 40.

It should be appreciated that the foregoing housings 102, 202, 202' are preferably constructed to have a unitary, single piece construction, such as by injection or blow molding, 3D printing, casting, machining, or any other practical and available means known to those skilled in the art, or can be multiple components secured together using any suitable mechanism.

It will be appreciated that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. The same reference numbers may be used to describe like or similar parts. Further, while several examples have been disclosed herein, any features from any examples may be combined with or replaced by other features from other examples. Moreover, while several examples have been disclosed herein, changes may be made to the disclosed examples within departing from the scope of the claims.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A retention assembly for securing a first end of an electrical cord to a power outlet of a vehicle, the retention assembly comprising:

a housing having an interior sized to receive a first end of an electrical cord therein with a plug portion of the first end received within a port electrically coupled to a power outlet of a vehicle, the housing including a front wall, a generally cylindrical sidewall extending rearwardly from a first end at the front wall to a second end and defining a rear opening sized to extend around the power outlet of the vehicle, and a flange extending outwardly from the second end of the sidewall; wherein the flange includes one or more openings extending therethrough to receive a fastener to secure the housing to a structure of the vehicle;

the front wall including a front opening extending therethrough, the front opening including an assembly portion sized to receive the first end or a second end of the electrical cord therethrough and a smaller, lateral retention portion sized to receive a wire portion of the electrical cord therein, wherein the retention portion is configured to align along an axis of the port; and a mounting base having one or more bores configured to align with the openings of the flange and receive a fastener therein to secure the housing to the mounting base.

2. The retention assembly of claim 1, wherein the housing further comprises a skirt extending rearwardly from an outer edge of the flange; and the mounting base has a tubular configuration sized to be received within a volume defined partially by the flange and skirt of the housing.

3. The retention assembly of claim 1, wherein the power outlet comprises an accessory outlet; the ports are USB ports provided by an adapter configured to be inserted into the accessory outlet; and the housing is sized to receive portions of the adapter therein with the housing secured to a structure of the vehicle.

4. The retention assembly of claim 1, wherein the front wall further comprises an outwardly projecting front flange to retain a wire portion of the electrical cord wrapped around the housing.

5. The retention assembly of claim 4, wherein the front flange includes one or more slot openings extending therethrough sized to retain the wire portion of the electrical cord inserted therein.

6. The retention assembly of claim 1, further comprising a spacer configured to engage a wire portion of the electrical cord and be sized to span a majority of a gap between the first end of the electrical cord and the front wall.

7. The retention assembly of claim 6, wherein the spacer comprises annular body having a longitudinal slit extending therethrough to be coupled around the wire portion of the electrical cord.

8. The retention assembly of claim 1, wherein the housing further comprises a divider wall extending across the interior that, in combination with the sidewall, define compartments for the first ends adjacent to the front wall.

9. The retention assembly of claim 8, wherein the divider wall defines a window adjacent to the front wall, the window having edges extending to edges of the front opening allowing a user to maneuver the first ends into the housing.

10. The retention assembly of claim 1, wherein the generally cylindrical sidewall comprises a generally half-barrel shaped sidewall.

11. The retention assembly of claim 1, wherein the interior of the housing is sized to receive first ends of two electrical cords therein in a side-by-side relation with plug portions of the first ends received within ports electrically coupled to the power outlet of the vehicle; and the front opening includes two smaller, lateral retention portions each sized to receive wire portions of one of the electrical cords therein, wherein the retention portions are configured to align along respective axes of the ports.

12. A retention assembly for securing a first end of an electrical cord to a power outlet of a vehicle, the retention assembly comprising:

an adapter having a body with a proximal end and a distal end, the proximal end including a port configured to receive a plug portion of a first end of an electrical cord therein and the distal end comprising a plug configured to electrically couple with a power outlet;

a housing having an interior sized to receive the first end of the electrical cord and portions of the proximal end of the adapter therein with the plug portion inserted into the port and the plug of the distal end of the adapter inserted into the power outlet, the housing including a front wall, a generally cylindrical sidewall extending rearwardly from a first end at the front wall to a second end defining a rear opening sized to extend around the power outlet of the vehicle, and a flange extending outwardly from the second end of the sidewall;

the front wall including a front opening extending therethrough, the front opening including an assembly portion sized to receive the first end or a second end of the electrical cord therethrough and a smaller, lateral retention portion sized to receive a wire portion of the electrical cord therein, wherein the retention portion is configured to align along an axis of the port.

13. The retention assembly of claim 12, wherein the adapter is a 12V auxiliary charger for vehicle 12V power outlets.

14. A retention assembly for securing a first end of an electrical cord to a power outlet of a vehicle, the retention assembly comprising:

a housing having an interior sized to receive a first end of an electrical cord therein with a plug portion of the first end received within a port electrically coupled to a power outlet, the housing including a front wall defining a front opening and a sidewall extending rearwardly from a first end at the front wall to a second end, the sidewall defining a rear opening sized to extend around the power outlet of the vehicle;

an insert sized to fit within the interior of the housing, the insert including a plug portion with a front wall configured to fit within the front opening of the housing, a shoulder extending outwardly from the plug portion configured to abut the front wall with the insert disposed within the housing, and a sidewall extending from the shoulder to a rear edge; and a slot opening of the insert having a first end in the front wall and a second end open through the rear edge of the sidewall, the slot opening sized to receive a wire portion of the electrical cord therethrough to position the first end within the insert.

15. The retention assembly of claim 14, wherein the first end of the slot opening aligns along an axis of the port.

16. The retention assembly of claim 14, wherein the housing further comprises a protrusion extending outwardly from the second end of the sidewall having a bore therethrough to receive a fastener and secure the housing to a structure of the vehicle.

17. The retention assembly of claim 16, wherein the housing further comprises a tab projecting outwardly and rearwardly from the second end of the sidewall opposite the protrusion, the housing configured to be secured to the structure of the vehicle by inserting the tab into an opening and subsequently inserting a fastener through the bore.

18. The retention assembly of claim 16, further comprising a mounting base having a bore configured to align with the bore of the protrusion and receive a fastener therein to secure the housing to the mounting base.

19. The retention assembly of claim 14, wherein the retention housing comprises a rear portion sized to extend around portions of an adapter projecting from the power outlet and a forward portion sized to extend around the insert and the first end of the electrical cord.

20. The retention assembly of claim 19, wherein the sidewall of the insert extends between the adapter and the front wall of the housing.

21. The retention assembly of claim 19, wherein the sidewall of the insert is complementary to the sidewall of the forward portion of the housing.

22. The retention assembly of claim 14, wherein the housing further comprises a flange projecting outwardly from an intermediate portion thereof, the flange including one or more slot openings extending therethrough sized to retain a wire portion of the electrical cord inserted therein.

23. The retention assembly of claim 14, further comprising a spacer configured to engage a wire portion of the electrical cord and be sized to span a majority of a gap between the first end of the electrical cord and the front wall of the insert.

24. The retention assembly of claim 23, wherein the spacer comprises annular body having a longitudinal slit extending therethrough to be coupled around the wire portion of the electrical cord.

25. A retention assembly for securing a first end of an electrical cord to a power outlet of a vehicle, the retention assembly comprising:

an adapter including a port on a proximal end configured to receive a plug portion of a first end of an electrical cord therein and a plug on a distal end configured to electrically couple with a power outlet;

a housing having an interior sized to receive the first end of the electrical cord and portions of the adapter therein with the plug portion inserted into the port and the adapter inserted into the power outlet, the housing including a front wall defining a front opening and a sidewall extending rearwardly from a first end at the front wall to a second end defining a rear opening sized to extend around the power outlet of the vehicle;

a rear portion of the housing sized to extend around portions of the adapter projecting from the power outlet;

a forward portion of the housing sized to extend around the first end of the electrical cord;

an insert sized to fit within the forward portion of the housing, the insert including a plug portion with a front wall, a shoulder extending outwardly from the plug portion, and a sidewall extending from the shoulder to a rear edge, such that, with the insert received within the forward portion of the housing, the plug portion is disposed within the front opening, the shoulder abuts the front wall, and the rear edge is adjacent to the proximal end of the adapter; and a slot opening of the insert having a first end in the front wall and a second end open through the rear edge of the sidewall, the slot opening sized to receive a wire portion of the electrical cord therethrough to position the first end within the insert.

26. The retention assembly of claim 25, wherein the adapter is a 12V auxiliary charger for vehicle 12V power outlets.

* * * * *